US007194972B2

(12) United States Patent
Schmitz, Sr.

(10) Patent No.: US 7,194,972 B2
(45) Date of Patent: Mar. 27, 2007

(54) VARIABLE-DRAFT VESSEL

(75) Inventor: Steven J. Schmitz, Sr., Sunnyvale, CA (US)

(73) Assignee: Lockheed Martin Corporation, Bethesda, MD (US)

( * ) Notice: Subject to any disclaimer, the term of this patent is extended or adjusted under 35 U.S.C. 154(b) by 0 days.

(21) Appl. No.: 11/196,204

(22) Filed: Aug. 3, 2005

(65) Prior Publication Data

US 2007/0028822 A1 Feb. 8, 2007

(51) Int. Cl.
*B63B 1/00* (2006.01)

(52) U.S. Cl. ..... 114/61.1; 114/61.15

(58) Field of Classification Search ..... 114/61.1, 114/61.14, 61.15, 61.16, 61.17, 61.18, 61.19
See application file for complete search history.

(56) References Cited

U.S. PATENT DOCUMENTS

| | | | | |
|---|---|---|---|---|
| 3,078,680 | A * | 2/1963 | Wepsala | 405/209 |
| 5,941,189 | A * | 8/1999 | Johansson | 114/61.1 |
| 6,877,450 | B2 | 4/2005 | Schmidt et al. | |
| 2004/0149196 | A1 | 8/2004 | Schmidt et al. | |

* cited by examiner

*Primary Examiner*—Stephen Avila
(74) *Attorney, Agent, or Firm*—DeMont & Breyer LLC

(57) ABSTRACT

A vessel that varies its draft by adopting any one of three primary hull forms or configurations is disclosed. The primary hull forms include: a catamaran configuration, a barge configuration, and a SWATH configuration. The vessel is capable of reconfiguring between these hull forms while underway. Reconfiguration is accomplished by vertical movement of a center hull and/or at least one of two side-hull members.

20 Claims, 7 Drawing Sheets

VARIABLE-DRAFT VESSEL

FIELD OF THE INVENTION

The present invention relates to sea-faring vessels. More particularly, the present invention relates to a vessel having a variable draft.

BACKGROUND OF THE INVENTION

Vessel hulls have traditionally been optimized for use in either shallow water or in deep water. For example, to navigate shallow waters, a relatively flat hull is used to maximize displacement and minimize draft. On the other hand, vessels that operate in deep waters frequently have v-shaped hulls that provide deep draft for good seakeeping.

If a vessel is designed for use in shallow waters, its performance in deep waters will be compromised, and vice-versa. This has spurred the development of variable-draft vessels, which are designed to operate well in both shallow and deep waters.

As the name implies, a variable-draft vessel is capable of varying its draft to accommodate changes in water depth or mission requirements. A variable-draft vessel that is disclosed in U.S. Pat. No. 6,877,450 B2 is capable of reconfiguring its hull form to change draft. The vessel includes a flat, center hull that is coupled to two side hulls. The center hull is vertically movable relative to the side hulls to vary draft.

According to the patent, the center hull can be moved above or below the waterline. When the center hull is above the waterline, all buoyancy is provided by the side hulls, and the vessel takes maximum draft. As the center hull dips below the waterline, it contributes to the buoyancy provided by the side hulls. As a consequence, vessel draft is reduced.

While variable-draft vessels are an advance over traditional fixed draft designs, they do have certain drawbacks. For example, the variable-draft vessels with a movable center hull that are disclosed in U.S. Pat. No. 6,877,450 B2 are not capable of varying draft independently of the center hull, unless buoyancy is altered through the use of ballast tanks, etc. This limits the extent to which this type of variable-draft vessel can be reconfigured.

SUMMARY OF THE INVENTION

The present invention provides a variable-draft vessel that avoids some of the disadvantages of the prior art.

In the illustrative embodiment, the vessel has a center hull that is coupled to two side hulls. Each side hull has two members. The center hull is vertically movable with respect to the side hulls and at least one of the two members of each side-hull are vertically movable with respect to the other side-hull member. In some embodiments, the vertical movements of the center hull and the side-hull members are independent of one another. In other words, there are two degrees of freedom as to vertical movement.

The vessel is capable of adopting any one of three primary hull forms or configurations, including: a catamaran configuration, a barge configuration, and a SWATH configuration. The vessel is capable of reconfiguring between these hull forms while underway. Reconfiguration is accomplished by vertical movement of the center hull and/or the side-hull members. The draft of the vessel is different for each of these three primary hull forms.

This independence of movement between the center hull and the side-hull members is particularly advantageous for configurations such as SWATH, for reasons that are explained later in this Specification.

DETAILED DESCRIPTION

The illustrative embodiment of the present invention is a vessel that adopts any one of three primary hull forms or configurations. These primary hull forms are: catamaran, barge, and SWATH. The vessel is capable of reconfiguring between these primary configurations while underway.

Figure 1:
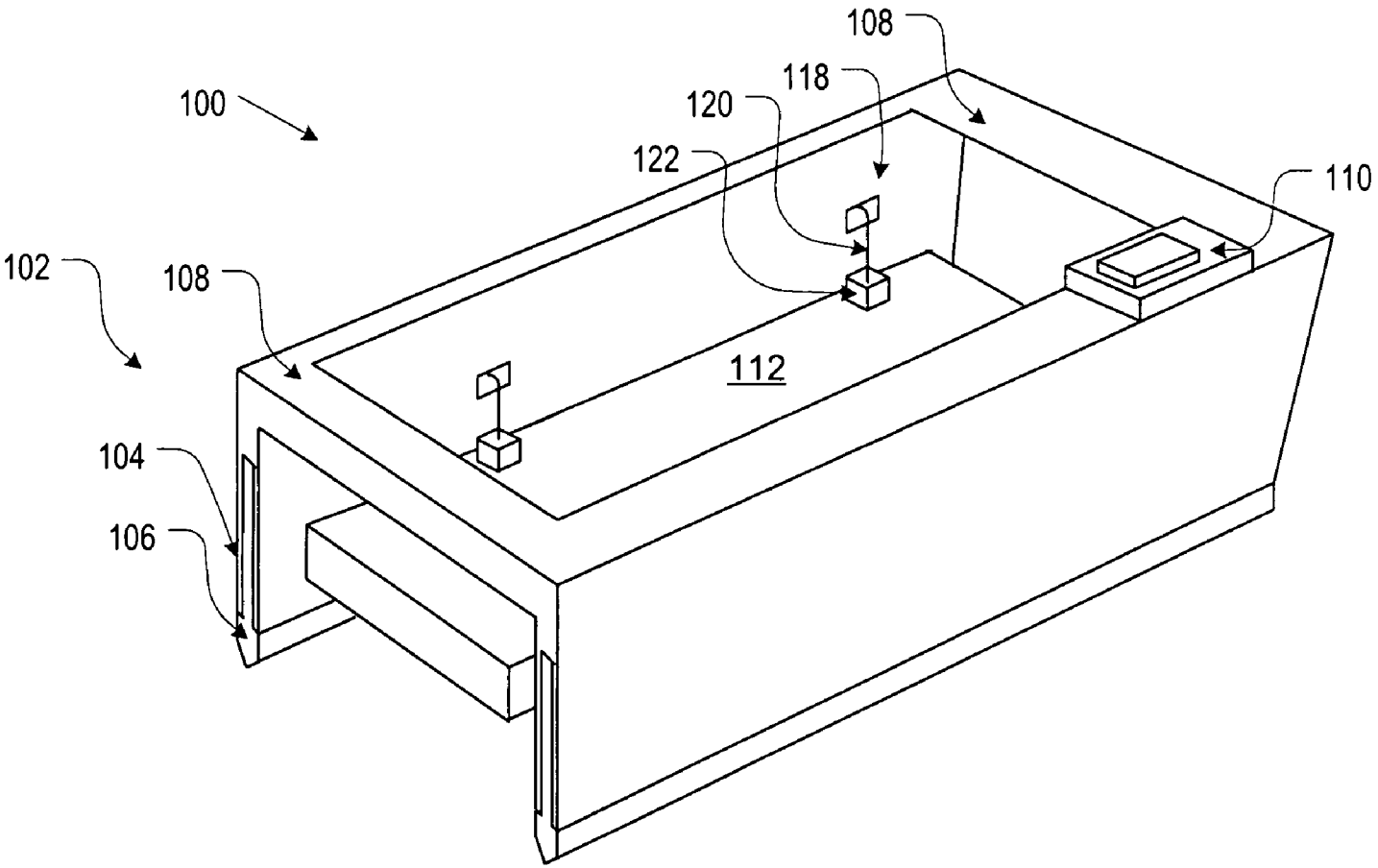
FIG. 1 depicts a simplified diagram of a vessel in accordance with the illustrative embodiment of the present invention.

FIG. 1 depicts a perspective view of vessel 100 in accordance with the illustrative embodiment of the present invention. Vessel 100 includes side hulls 102, cross supports 108, control room 110, and center hull 112. Cross supports 108 are rigidly coupled to side hulls 102 to provide structural integrity and stability to vessel 100. Control room 110 houses the equipment necessary for piloting vessel 100.

It will be understood that vessel 100 includes other elements, such as a drive system (e.g., engines, water jets, props, etc.), deployment ramps, and the like. These elements are not pictured or described to maintain the focus on elements that are germane to an understanding of the present invention.

Each side hull 102 comprises two members 104 and 106, at least one of which is movable. Depending upon the hull form of vessel 100 (e.g., catamaran, barge, SWATH, etc.), either one or both of the side-hull members 104 and 106 are partially submerged, providing some or all of the buoyancy required for vessel 100.

Center hull 112 is used for carrying cargo, etc. In the illustrative embodiment, the center hull is movably coupled to side hulls 102 such that its height relative to the water is adjustable. For example, center hull 112 can be raised to a position where it is substantially above the waterline or lowered so that at least a portion of it is submerged.

The height of center hull 112 is adjustable through the use of height-adjusting mechanism 118. In the embodiment that is depicted in FIG. 1, four height-adjusting mechanisms 118 (only two are visible the Figure) comprising wire rope 120 and winch 122 are used to raise and lower the center hull.

Figure 4:
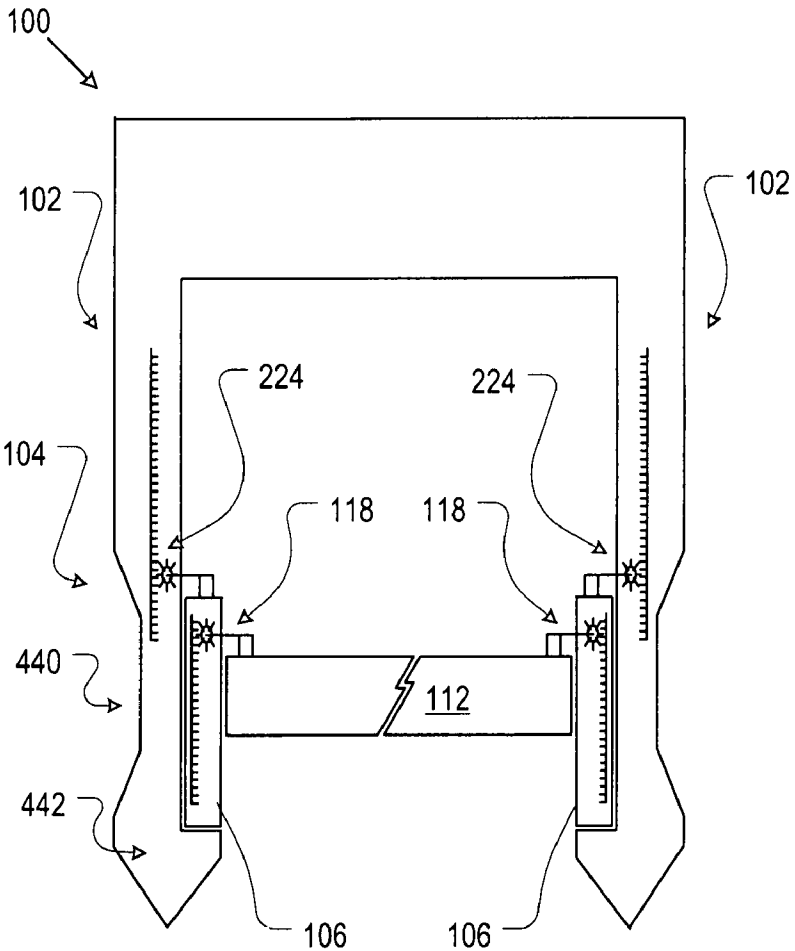
FIG. 4 depicts a first alternative embodiment of the structure of the side hulls.
Figure 3:
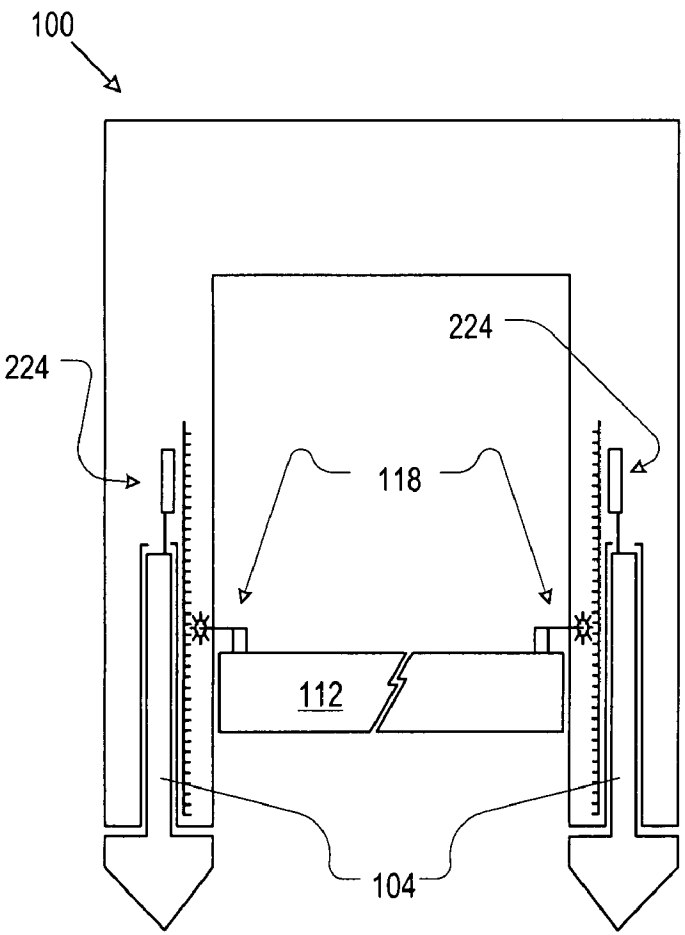
FIG. 3 depicts a first alternative embodiment of a mechanism for vertically moving the center hull.

In some other embodiments, other types of height-adjusting mechanisms, such as chain jacks, hydraulics, cables and electric motors, rack and pinion gears, and the like, are used (see, e.g., FIGS. 3 and 4). Those skilled in the art, after reading this disclosure, will know how to make and use a height-adjusting mechanism suitable for changing the height of center hull 112.

In the illustrative embodiment, center hull 112 is coupled to side-hull member 106. As a consequence, the vertical position of center hull 112 can be affected to some extent by the position of side-hull member 106. But the inclusion of two height-adjustment mechanisms (e.g., mechanism 118 for center hull 112 and a second mechanism for moving at least one of the side-hull members), in accordance with the illustrative embodiment of the present invention, provides center hull 112 with some degree of independence from side-hull member 106. The significance of this feature will become clearer later in this Specification.

FIGS. 2A through 2D depict end views of vessel 100, showing cross support 108, side-hull members 104 and 106, and center hull 112. These Figures depict a first exemplary configuration of side hulls 102 (i.e., the structure of and relationship between members 104 and 106) and depict exemplary height-adjustment mechanisms 118 and 224.

As to the structure of the side hulls 102, side-hull member 104 is fixed and side-hull member 106 is movable via the action of height adjustment mechanism 224. In the embodiment depicted in FIGS. 2A through 2D, mechanism 224 is a hydraulic actuator.

Channel 226 is formed in side hull member 104. Channel 226 receives strut 230 of side-hull member 106. Strut 230 widens, at its lower end, defining pontoon 232.

Height-adjustment mechanism 118, which in the embodiment that is depicted in FIGS. 2A through 2D is a cable and winch arrangement, adjusts the height of center hull 112. It is notable that in this embodiment, height-adjustment mechanism 118 couples center hull 112 to side-hull member 106 via cable 120. As a consequence, center hull 112 moves in response to movement of side-hull member 106.

FIGS. 2A through 2D illustrate the various ways in which side-hull members 104 and 106 and center hull 112 can be moved to reconfigure vessel 100 and alter its draft. It is to be understood that within the range of motion of movable side-hull member 106 and center hull 112, as dictated by the height-adjustment mechanisms, etc., these elements are substantially infinitely adjustable.

Figure 2B:
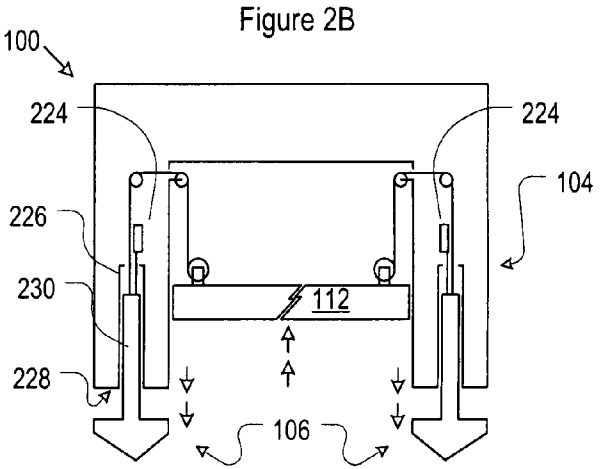
FIGS. 2A–2D depicts an embodiment of the side hulls of the vessel of FIG. 1, depicts embodiments of mechanisms for vertically translating the side hulls and the center hull, and depicts various ways in which the vessel of FIG. 1 can be reconfigured.
Figure 2D:
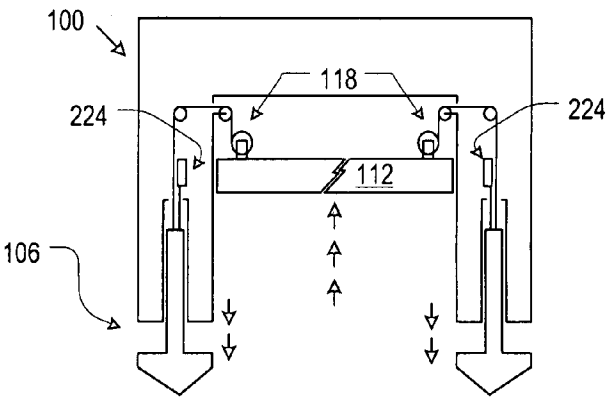
Figure 2A:
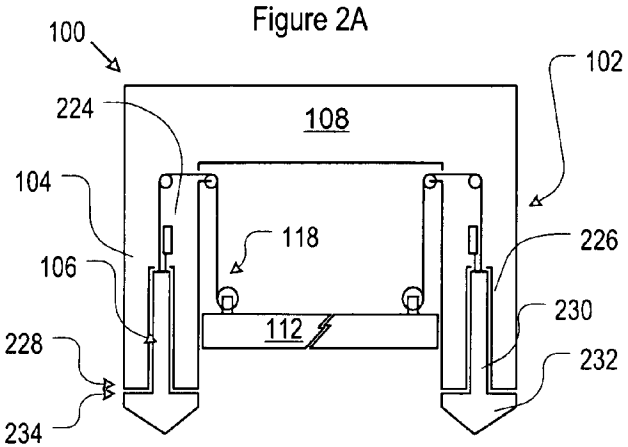

Turning now to the issue of "reconfiguration," FIG. 2A depicts side hulls 102 in a reference position. In this reference position, lower surface 228 of side-hull member 104 and upper surface 234 of pontoon 232 of side-hull member 106 are in abutting or near-abutting relation (hereinafter referred to as the side-hull member 106 being "fully retracted"). In other words, there is no vertical translation of side-hull member 106.

FIG. 2B depicts side-hull member 106 in a partially extended or partially vertically-translated state, as actuated by mechanism 224. Urged to motion by mechanism 224, strut 230 slides through channel 226, coming to rest at a position in which it partially extends beyond lower surface 228 of side-hull member 104. Due to the coupling of center hull 112 and side-hull member 106, as side-hull member 106 is moved downwardly, center hull 112 moves upward.

Figure 2C:
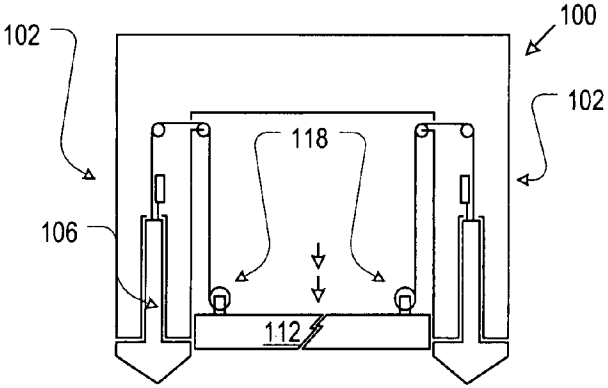

FIG. 2C depicts side hulls 102 back in the reference position. This Figure illustrates independent movement of center hull 112. In particular, the height of center hull 112 is reduced (via mechanism 118), while side-hull member 106 is not extended.

FIG. 2D depicts side-hull member 106 extended (by mechanism 224) as in FIG. 2B. In addition, center hull 112 is raised via mechanism 118.

Thus, FIGS. 2A through 2D illustrate the manner in which vessel 100 can be reconfigured based on the available two degrees of freedom of movement. The subject of reconfiguration will be described in further detail later in this Specification in conjunction with FIGS. 6A through 6C, 7A through 7C, and 8A through 8D. Also, the relationship between the draft of vessel 100 and the relative position of side-hull members 104 and 106 will be described in conjunction with FIGS. 5A and 5B.

It is to be understood that a wide variety of side-hull configurations and height-adjustment mechanisms can be used to implement the present invention. FIGS. 3 and 4 depict examples of additional height-adjustment mechanisms and an alternative configuration of side-hull members 104 and 106. These Figures depict vessel 100 from the same end view as FIGS. 2A through 2D, but at a magnified scale.

In the embodiment that is depicted in FIG. 3, and unlike the embodiment that was depicted in FIGS. 2A through 2D, height-adjustment mechanisms 118 and 224 are independent of one another. Nevertheless, the height of center hull 112 is affected by the vertical position side-hull member 104. Height-adjustment mechanism 118 is depicted as a rack-and-pinion arrangement (drive system not depicted for the sake of clarity) and height-adjustment mechanism 224 is again depicted as a hydraulic actuator.

FIG. 4 depicts an alternative embodiment of side-hulls 102. In this embodiment, side-hull member 104 narrows at region 440, and then widens defining pontoon 442. In this embodiment, movable side-hull member 106 moves upward, as opposed to downward as in the embodiment depicted in FIGS. 2A through 2D. Side-hull member 106 is driven by height-adjustment mechanism 224, which is implemented as a rack-and-pinion arrangement. As side-hull member 106 moves upward, center hull 112 is carried upward as well. The height of center hull 112 can be further adjusted, downward, using height-adjustment mechanism 118, again depicted as a rack-and-pinion arrangement.

In all embodiments that have been depicted, center hull 112 can be raised well above the waterline and, also, can be at least partially submerged. This capability is important in terms of the ability of vessel 100 to reconfigure into a variety of configurations.

Figure 5B:
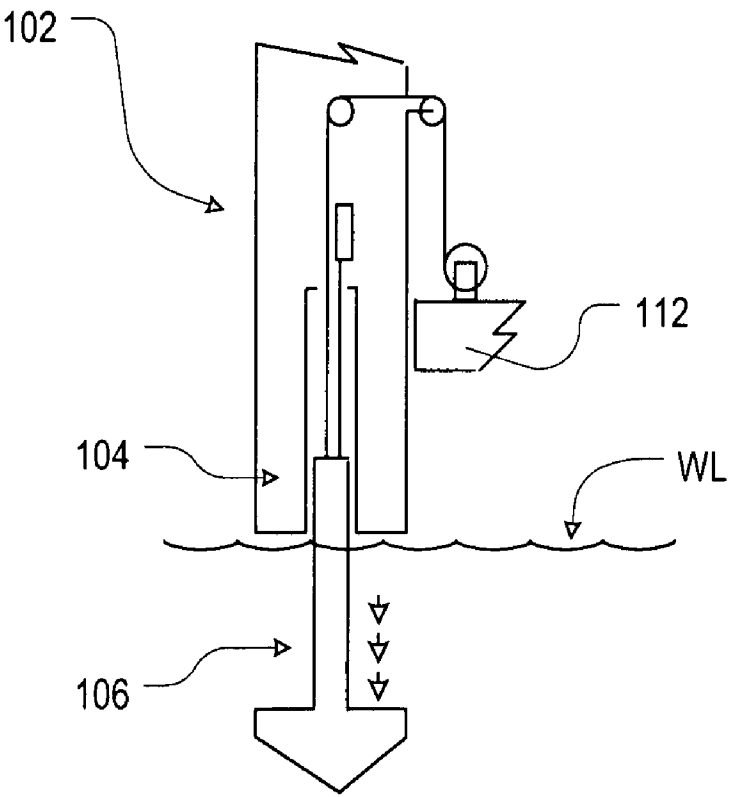
FIGS. 5A and 5B depicts the draft of the vessel of FIG. 1 as a function of the relative position of the side hull members.
Figure 5A:
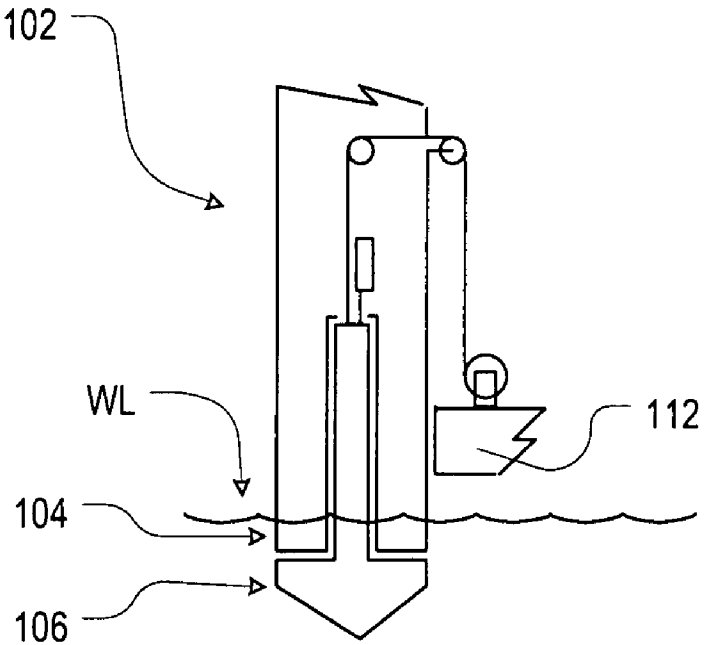

FIG. 5A depicts a partial view of one side hull 102 and center hull 112. This Figure depicts side hull 102 in the reference position, wherein side-hull member 106 is fully retracted. As depicted in the Figure, when side-hull 102 is in the reference position, and when center hull 112 is above waterline WL, a portion of both side-hull member 104 and side-hull member 106 are below the waterline. As will become clearer in conjunction with the description of FIGS. 6A through 6C, 7A through 7C, and 8A through 8D, this enables vessel 100 to reconfigure to three substantially different hull forms with no change vessel in buoyancy (i.e., without having to change ballast).

FIG. 5B depicts the same view as FIG. 5A, but with side-hull member 106 extended. In FIG. 5B, member 106 is sufficiently extended to provide all the buoyancy that is required by vessel 100, such that side-hull member 104 is above waterline WL.

Figure 6C:
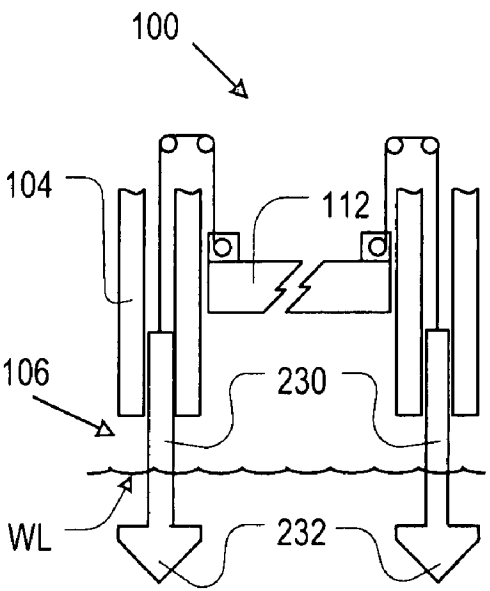
FIG. 6C depicts the vessel of FIG. 1 in a SWATH configuration.
Figure 6B:
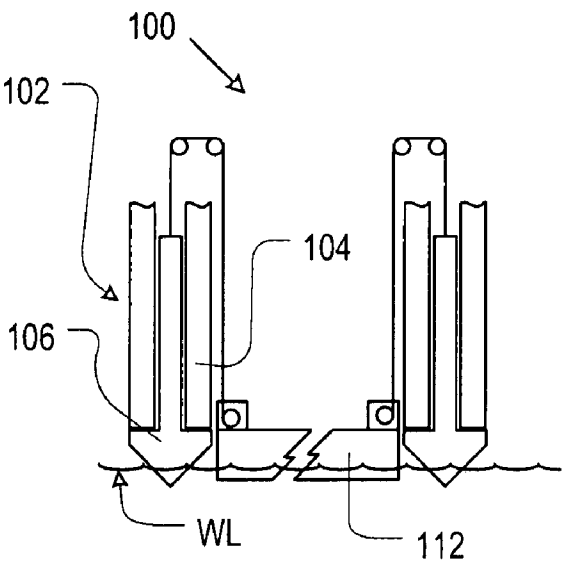
FIG. 6B depicts the vessel of FIG. 1 in a barge configuration.
Figure 6A:
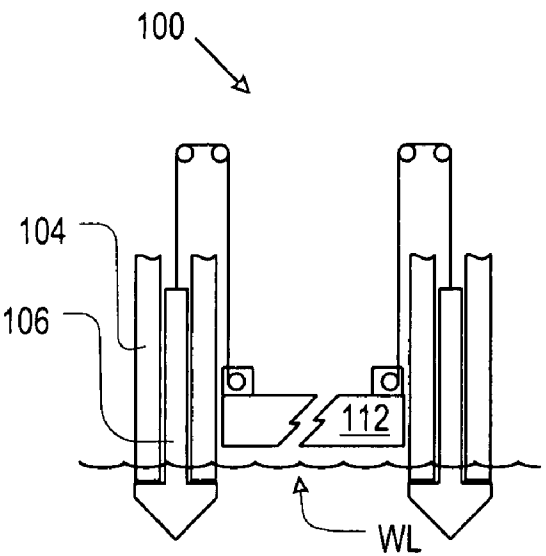
FIG. 6A depicts the vessel of FIG. 1 in a catamaran configuration.

FIGS. 6A through 6C depict the three primary hull forms or configurations of vessel 100 (cross support 108 is omitted from these Figures for clarity).

FIG. 6A depicts vessel 100 in a catamaran configuration. In the catamaran configuration, both side-hull members 104 and 106 are partially below waterline WL. Center hull 112 is somewhat above the waterline.

FIG. 6B depicts vessel 100 in the barge configuration. In this configuration, center hull 112 is partially submerged, such that substantially less buoyancy is required from side hulls 102. As a consequence, side hulls 102 float higher in the water and, in fact, side-hull member 104 is completely above waterline WL while side-hull member 106 is only minimally submerged. In some embodiments (not depicted), center hull 112 is coupled to side hulls 102 or cross supports 108 such that all buoyancy is provided by center hull 112; that is, side hulls 102 are above the waterline.

FIG. 6C depicts vessel 100 in the SWATH configuration. "SWATH" is an acronym for "small waterplane area twin hull." A SWATH craft consists of two lower hulls or pontoons that are connected to an upper hull by struts. The lower hulls are submerged such that they ride below the surface of the water. The submerged lower hulls do not follow the surface wave motion. The struts, which lift the upper hull above the water, have a small waterplane area (i.e., the cross sectional area at the waterline). This results in longer natural periods and reduced buoyancy-force changes. A SWATH craft is typically much more stable in high sea-state conditions than conventional hulls of the same length. But the stability advantage of SWATH craft is lost if waves come into contact with the upper hull. As a consequence, the larger the distance between the lower hulls and the upper hull, the higher the sea state in which the SWATH craft can maintain stable operation.

In the context of vessel 100, and with reference to FIG. 3D, pontoon 232 of each side-hull member 106 functions as a "lower hull," collectively being the "twin hull" mentioned above. Struts 230 of side-hull member 106, which are substantially narrower than side-hull member 104, serve as the small-waterplane-area struts that are mentioned above. Center hull 112 is the "upper hull."

For maximum stability and to operate in the highest sea state possible for vessel 100, side-hull member 106 should be fully extended and center hull 112 should be raised as high as possible above waterline WL.

Figure 7C:
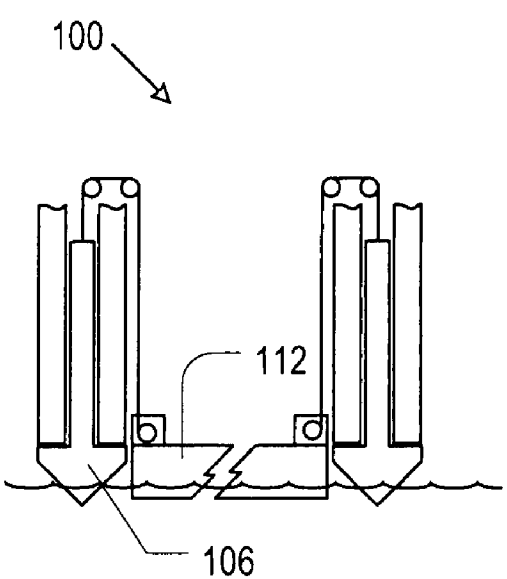
FIGS. 7A–7C depicts the vessel of FIG. 1 in the process of reconfiguring from the catamaran configuration to the barge configuration.
Figure 7B:
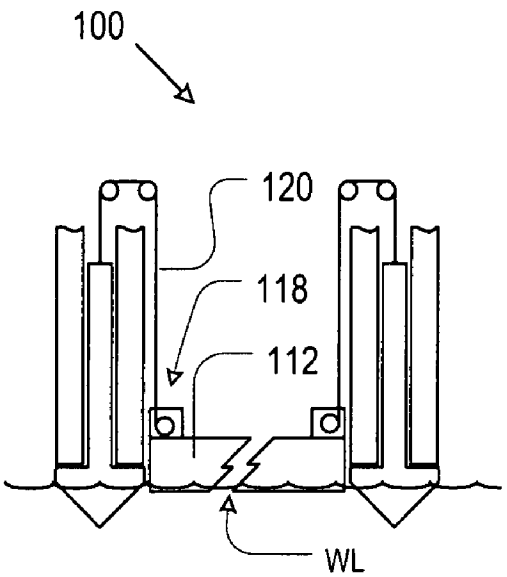
Figure 7A:
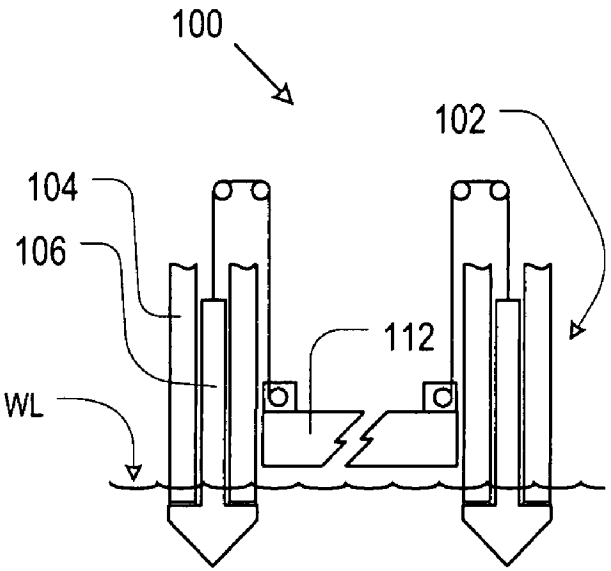

FIGS. 7A through 7C depict the reconfiguration of vessel 100 from a catamaran to a barge hull form.

FIG. 7A depicts vessel 100 in a catamaran configuration, as previously presented in FIG. 6A. To reconfigure to the barge hull form, center hull 112 is dropped from its position somewhat above waterline WL to a partially submerged position. There is no movement of side-hull members 104 and 106 relative to one another; that is, side hull 102 is in the reference position (i.e., side-hull member 106 remains retracted).

FIG. 7B depicts vessel 100 as it reconfigures, wherein the lower surface of center hull 112 has just touched the water. In the context of winched-based, height-adjusting mechanism 118, additional cable 120 is paid-out to drop center hull 112 toward waterline WL. FIG. 7C depicts vessel 100 fully reconfigured to a barge hull form, wherein side-hull member 106 and center hull 112 are both providing buoyancy, and vessel 100 exhibits a relatively small amount of draft.

Figure 8A:
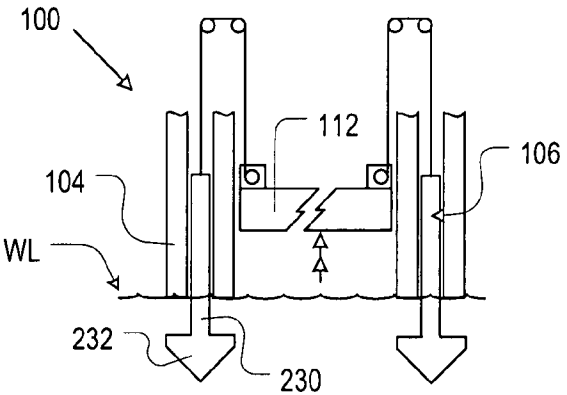
FIGS. 8A–8D depicts the vessel of FIG. 1 in the process of reconfiguring from a catamaran configuration to the SWATH configuration.
Figure 8B:
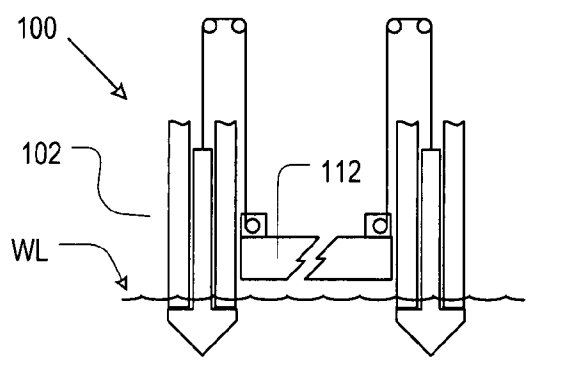
Figure 8C:
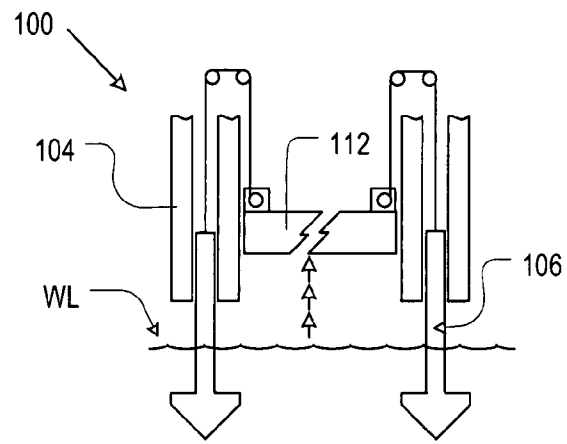
Figure 8D:
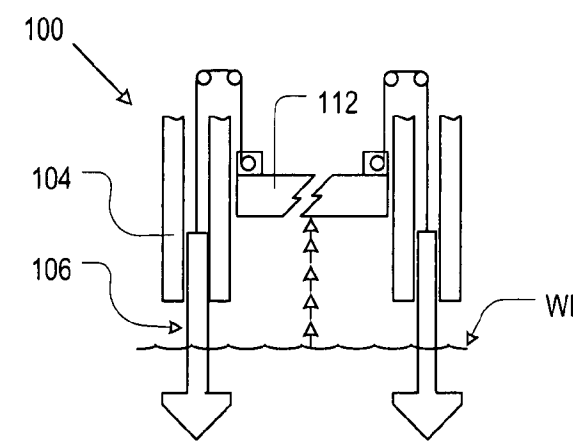

FIGS. 8A through 8D depict the reconfiguration of vessel 100 from a catamaran to a SWATH hull form. FIG. 8A depicts the catamaran hull form, wherein side hulls 102 are in the reference position and center hull 112 is somewhat above waterline WL. FIG. 8D depicts the SWATH hull form. FIGS. 8B and 8C depict intermediate configurations during the process of reconfiguring from the catamaran to the SWATH hull form.

Referring now to FIG. 8B, vessel 100 is depicted in a first intermediate configuration wherein side-hull member 106 has been extended such that it provides substantially all buoyancy for vessel 100; side-hull member 104 is just above waterline WL. At this point, vessel 100 exhibits the submerged lower hulls (pontoons 232) and small-waterplane struts (struts 230) of a SWATH configuration. Note that by virtue of the coupling of center hull 112 to side-hull member 106, the center hull moves in the desired direction (i.e. upward) for high-sea-state operation.

FIG. 8C depicts a second intermediate configuration of vessel 100 wherein the height of side-hull member 104 above waterline WL is increased. This is accomplished by further extending side-hull members 106. It is notable that since all buoyancy was being provided by side-hull member 106 in the configuration shown in FIG. 8B, extending the side-hull member further will not affect draft. The result is that side-hull member 104 rides higher above waterline WL. Although the draft of vessel 100 does not change between the configuration of FIGS. 8B and 8C, the height of center hull 112 above the waterline WL nevertheless increases. This is a consequence of the further vertical translation of side-hull member 106 (for this particular arrangement).

To transition from the second intermediate configuration, as depicted in FIG. 8C, to the SWATH configuration that is depicted in FIG. 3D, center hull 112 is raised; there is no change in side-hull members 104 and 106. Due to the relatively large distance between the bottom of center hull 112 and waterline WL, vessel 100 can operate in high sea states when it is configured as in FIG. 8D. This is a benefit of being to raise center hull 112 independently of any movement of side-hull member 106.

Returning to the embodiment that is depicted in FIG. 4, it will now be appreciated that the shape of side-hull member 104 (i.e., narrowed region 440 and pontoon 442) supports a SWATH configuration. In particular, it was disclosed in conjunction with FIGS. 5A and 5B that the buoyancy of vessel 100 is set so that when side hulls 102 are fully retracted, a portion of both side-hull members 104 and 106 are submerged. Thus, to place vessel 100 of FIG. 4 in a SWATH mode, side-hull member 106 is raised via mechanism 224. As this occurs, vessel 100 takes more draft, such that the waterline falls within small-water-plane area region 440, while pontoons 442 are submerged. Since independent adjustment of center hull 112 via mechanism 118 can only decrease the height of center hull 112, its height is not independently adjusted.

It is to be understood that the above-described embodiments are merely illustrative of the present invention and that many variations of the above-described embodiments can be devised by those skilled in the art without departing from the scope of the invention. For example, in this Specification, numerous specific details are provided in order to provide a thorough description and understanding of the illustrative embodiments of the present invention. Those skilled in the art will recognize, however, that the invention can be practiced without one or more of those details, or with other methods, materials, components, etc.

Furthermore, in some instances, well-known structures, materials, or operations are not shown or described in detail to avoid obscuring aspects of the illustrative embodiments. It is understood that the various embodiments shown in the Figures are illustrative, and are not necessarily drawn to scale. Reference throughout the specification to "one embodiment" or "an embodiment" or "some embodiments" means that a particular feature, structure, material, or characteristic described in connection with the embodiment(s) is included in at least one embodiment of the present invention, but not necessarily all embodiments. Consequently, the appearances of the phrase "in one embodiment," "in an embodiment," or "in some embodiments" in various places throughout the Specification are not necessarily all referring to the same embodiment. Furthermore, the particular features, structures, materials, or characteristics can be combined in any suitable manner in one or more embodiments. It is therefore intended that such variations be included within the scope of the following claims and their equivalents.

What is claimed is:

1. A vessel comprising:

a center hull; and a first side hull, wherein said center hull is coupled to said first side hull, and wherein said first side hull comprises a first member and a second member, and further wherein said center hull and said first side hull are configured so that:

(i) said center hull is vertically movable relative to said first side hull;

(ii) said second member is vertically movable with respect to said first member; and (iii) said center hull is vertically movably independently of vertical movement of said second member.

2. The vessel of claim 1 further comprising a second side hull, wherein said center hull is coupled to said second side hull, and wherein said second side hull comprises a first member and a second member, and further wherein said center hull and said second side hull are configured so that:

(i) said center hull is vertically movable relative to said second side hull;

(ii) said second member of said second side hull is vertically movable with respect to said first member of said second side hull; and (iii) said center hull is vertically movable independently of vertical movement of said first member of said second side hull.

3. The vessel of claim 1 further comprising a height-adjustment mechanism for adjusting a height of said center hull.

4. The vessel of claim 1 further comprising a height-adjustment mechanism for vertically moving said second member of said first side hull relative to said first member of said first side hull.

5. The vessel of claim 1 wherein, in a catamaran configuration:

(i) said first member and said second member are in a reference position in which said second member in not moved away from said first member;

(ii) said first member is partially below said waterline;

(iii) said second member is partially below said waterline, wherein said second member displaces a first volume of water; and (iv) said center hull is at a first height above said waterline.

6. The vessel of claim 5 wherein, in a barge configuration:

(i) said first member and said second member are in said reference position;

(ii) said first member is above said waterline;

(iii) said center hull is partially below said waterline.

7. The vessel of claim 6 and further wherein, in said barge configuration:

(iv) said second member is partially below said waterline;

(v) said second member displaces a second volume of water; and (vi) said second volume is less volume than said first volume.

8. The vessel of claim 6 wherein vessel buoyancy is the same in said barge configuration and said catamaran configuration.

9. The vessel of claim 5 wherein, in a SWATH configuration:

(i) said second member is vertically extended relative to said first member;

(ii) said first member is above said waterline;

(iii) said second member is partially below said waterline, and wherein said second member displaces a second volume of water, and further wherein said second volume is greater than said first volume; and (iv) said center hull is at a second height above said waterline, wherein said second height is greater than said first height.

10. The vessel of claim 9 wherein vessel buoyancy is the same in said SWATH configuration and said catamaran configuration.

11. A vessel comprising:

a center hull; and two side hulls, wherein said center hull is movably coupled to said side hulls, and wherein each side hull comprises a first member and a second member, and further wherein said second member is vertically movable with respect said second member, wherein:

said center hull, said first member, and said second member are configured so that a height of said center hull above a waterline is variable independently of movement of said either second member.

12. The vessel of claim 11 wherein buoyancy of said vessel is constant.

13. The vessel of claim 11 wherein said center hull, said first member, and said second member are configured so that said vessel draft is variable while said center hull is maintained at a constant distance above said waterline.

14. The vessel of claim 11 wherein said center hull, said first member, and said second member are configured so that said vessel is reconfigurable between a SWATH configuration, a catamaran configuration, and a barge configuration.

15. A method for operating a vessel, the method comprising:

maintaining constant buoyancy; and at least one of either:

(a) vertically translating at least a first side-hull member relative to a second side-hull member, wherein:

(i) in a reference, non-translated position, both of said first side-hull member and said second side-hull member are partially below a waterline;

(ii) in a translated position, said side-hull member is above said waterline and said second side-hull member is partially below said waterline; and (b) vertically translating a center hull relative to said first side-hull member and said second side-hull member.

16. The method of claim 15 wherein, when reconfiguring from a catamaran configuration to a SWATH configuration, said first side-hull member is moved vertically relative to said second side-hull member and said center hull is moved vertically upward.

17. The method of claim 15 wherein, when reconfiguring from a catamaran configuration to a barge configuration, said center hull is vertically moved from a first position above said waterline to a second position partially below said waterline, but said first side-hull member is not moved relative to said second side-hull member.

18. The method of claim 15 further comprising changing draft by vertically moving said first side-hull member between said reference position and said translated position.

19. The method of claim 15 further comprising changing draft by vertically translating said center hull from a position above said waterline to a position in which it is at least partially below said waterline.

20. The method of claim 15 further comprising vertically translating said first side-hull member while maintaining said center hull at a constant height above said waterline.

* * * * *